US007784717B2

(12) United States Patent
Smith

(10) Patent No.: US 7,784,717 B2
(45) Date of Patent: Aug. 31, 2010

(54) METHODS AND APPARATUS FOR FABRICATING COMPONENTS

(75) Inventor: Douglas R. Smith, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 73 days.

(21) Appl. No.: 11/237,234

(22) Filed: Sep. 28, 2005

(65) Prior Publication Data

US 2007/0241215 A1 Oct. 18, 2007

(51) Int. Cl.
*B05B 1/00* (2006.01)

(52) U.S. Cl. ..... 239/596; 239/128; 239/600; 239/601; 407/11

(58) Field of Classification Search ..... 239/596, 239/600, 128, 555, 589, 597, 428.5, 589.1; 407/11, 2; 82/50; 451/7
See application file for complete search history.

(56) References Cited

U.S. PATENT DOCUMENTS 4,596,364 A * 6/1986 Bauer ..... 239/589.1
5,035,361 A * 7/1991 Stouffer ..... 239/589.1
5,803,371 A * 9/1998 Sugiyama et al. ..... 239/555
6,045,300 A 4/2000 Antoun
6,471,448 B1 * 10/2002 Lagerberg ..... 407/2
6,669,118 B2 * 12/2003 Webster ..... 239/548
6,769,956 B1 8/2004 Konieczny
6,920,749 B2 * 7/2005 Mansour et al. ..... 60/39.53
2004/0250837 A1 * 12/2004 Watson et al. ..... 134/25.2

* cited by examiner

*Primary Examiner*—Darren W Gorman
(74) *Attorney, Agent, or Firm*—William Scott Andes, Esq.; Armstrong Teasdale LLP

(57) ABSTRACT

A method for fabricating a nozzle includes providing at least two plates. At least one of the at least two plates includes a first opening. Each plate includes at least one mating surface. The method also includes stacking the at least two plates together such that a mating surface of a first of the at least two plates is substantially flush against a mating surface of a second of the at least two plates, and such that a fluid passage is at least partially defined by the at least two plates. The method also includes orienting the at least two plates relative to each other such that the opening within at least one of the at least two plates at least partially defines an outlet for discharging fluid from the fluid passage.

16 Claims, 6 Drawing Sheets

METHODS AND APPARATUS FOR FABRICATING COMPONENTS

BACKGROUND OF THE INVENTION

This invention relates generally to fabricating components, and more specifically to supplying coolant to components during fabrication thereof.

For at least some known machining processes, for example multi-axis milling or grinding processes, components may be coupled to a fixture that is mounted on a table that rotates and translates about at least one axis to facilitate machining various surfaces of the component. To avoid heat damage to the component, cooling fluid may be discharged toward the machining zone to facilitate cooling the component during machining. Stationary nozzles are sometimes used to direct cooling fluid toward the machining zone, however, depending on the orientation of the component, it may be difficult to provide adequate cooling fluid to the machining zone. For example, depending on the component, a path of coolant discharged from such stationary nozzles may become obstructed as the component is reoriented.

Accordingly, to ensure an adequate supply of cooling fluid is available, at least some known nozzles are coupled to the fixture such that the nozzle moves with the fixture and is maintained in the same alignment with respect to the machining zone during movement of the fixture. For example, cylindrical tubes are sometimes coupled to the fixture and bent into position to direct cooling fluid toward the machining zone. However, nozzles coupled to the fixture may inadvertently become damaged or misaligned as the component is coupled to the fixture, and/or during maintenance of the fixture. Moreover, some known nozzles are coupled to the fixture using fittings that may loosen during movement of the fixture, thus enabling the nozzles to become misaligned. Damage to, and/or misalignment of, such nozzles may cause insufficient cooling fluid to be supplied to the machining zone, which may damage the component.

BRIEF DESCRIPTION OF THE INVENTION

In one aspect, a method is provided for fabricating a nozzle. The method includes providing at least two plates. At least one of the at least two plates includes a first opening. Each plate includes at least one mating surface. The method also includes stacking the at least two plates together such that a mating surface of a first of the at least two plates is substantially flush against a mating surface of a second of the at least two plates, and such that a fluid passage is at least partially defined by the at least two plates. The method also includes orienting the at least two plates relative to each other such that the opening within at least one of the at least two plates at least partially defines an outlet for discharging fluid from the fluid passage.

In another aspect, a nozzle includes at least two plates each having at least one mating surface. The at least two plates are stacked together such that a mating surface of a first of the at least two plates is substantially flush against a mating surface of a second of the at least two plates and such that a fluid passage is at least partially defined by the at least two plates. At least one of the at least two plates includes an opening that at least partially defines an outlet for discharging fluid from the fluid passage.

In yet another aspect, a nozzle assembly includes a base including a first fluid passage and a first opening. The first fluid passage extends from a first end that is generally adjacent the first opening to a second end. The first fluid passage is configured to couple in flow communication with a source of fluid. The nozzle assembly also includes a nozzle including at least two plates each having at least one mating surface. The at least two plates are stacked together at least partially within the first opening such that a mating surface of a first of the at least two plates is substantially flush against a mating surface of a second of the at least two plates and such that a second fluid passage is at least partially defined by the at least two plates. The second fluid passage is in flow communication with the first end of the first fluid passage for receiving fluid therefrom. At least one of the at least two plates includes a second opening that is in flow communication with the second fluid passage and that at least partially defines an outlet for discharging fluid from the second fluid passage.

DETAILED DESCRIPTION OF THE INVENTION

As used herein the terms "machining," "machine," and "machined" may include any process used for shaping a component. For example, processes used for shaping a component may include, but are not limited to including, turning, planing, milling, grinding, finishing, polishing, and/or cutting. In addition, and for example, shaping processes may include, but are not limited to including, processes performed by a machine, a machine tool, and/or a human being. The above examples are intended as exemplary only, and thus are not intended to limit in any way the definition and/or meaning of the terms "machining," "machine," and "machined". In addition, as used herein the term "component" may include any object that has been or may be machined.

Figure 1:
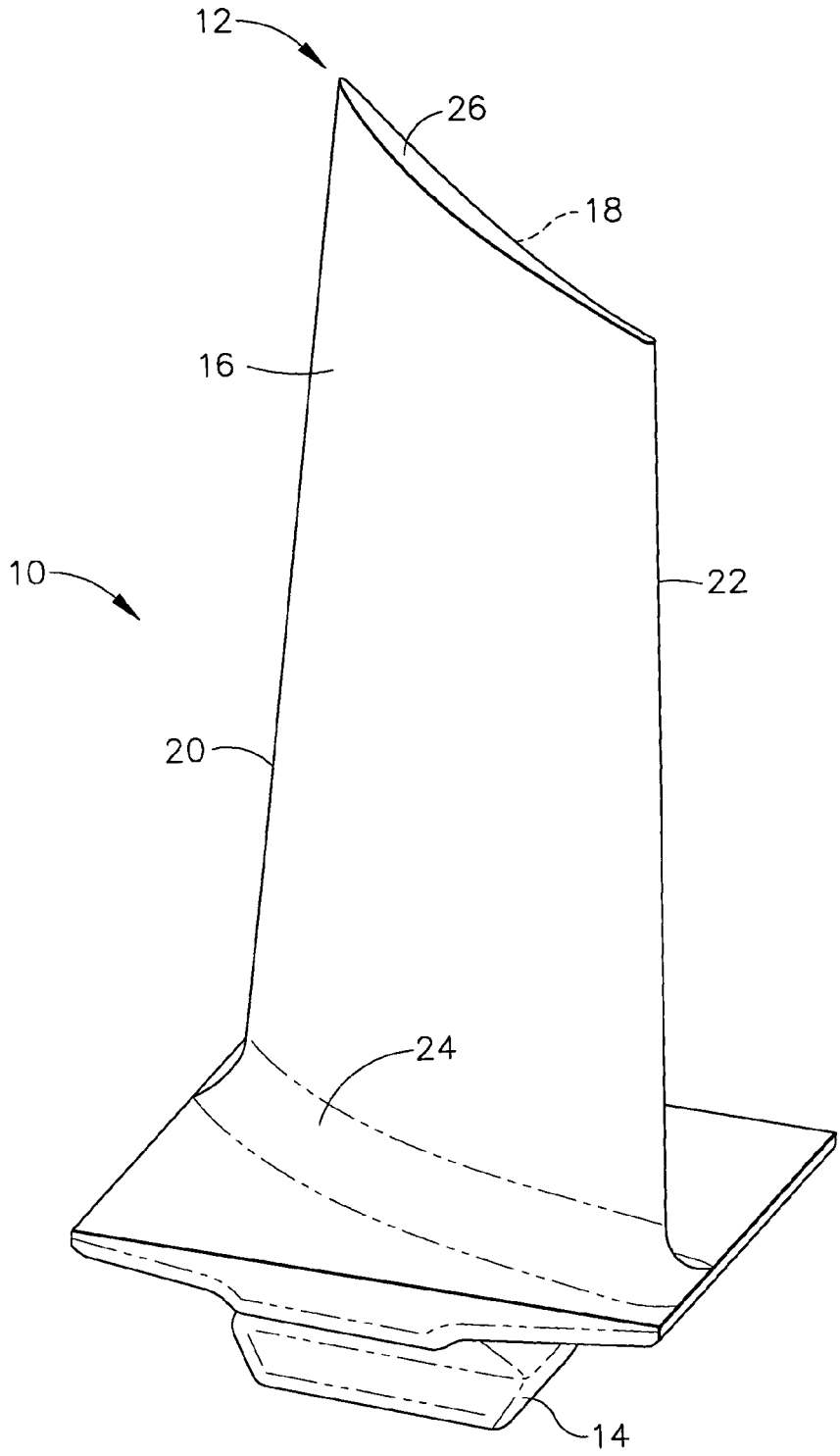
FIG. 1 is a perspective view of an exemplary gas turbine engine blade.

FIG. 1 is a perspective view of an engine blade 10 that may be used with a gas turbine engine (not shown). In some embodiments, a plurality of turbine blades 10 form a high-pressure turbine rotor blade stage (not shown) of the gas turbine engine. Each blade 10 includes an airfoil 12 and an integral dovetail 14 that is used for mounting airfoil 12 to a rotor disk (not shown) in a known manner. Alternatively, blades 10 may extend radially outwardly from a disk (not shown), such that a plurality of blades 10 form a blisk (not shown). Each airfoil 12 includes a first contoured sidewall 16 and a second contoured sidewall 18. First sidewall 16 is convex and defines a suction side of airfoil 12, and second sidewall 18 is concave and defines a pressure side of airfoil 12. Sidewalls 16 and 18 are joined at a leading edge 20 and at an axially-spaced trailing edge 22 of airfoil 12. More specifically, airfoil trailing edge 22 is spaced chordwise and downstream from airfoil leading edge 20. First and second sidewalls 16 and 18, respectively, extend longitudinally or radially outward in span from a blade root 24 positioned adjacent dovetail 14, to an airfoil tip 26.

Figure 2:
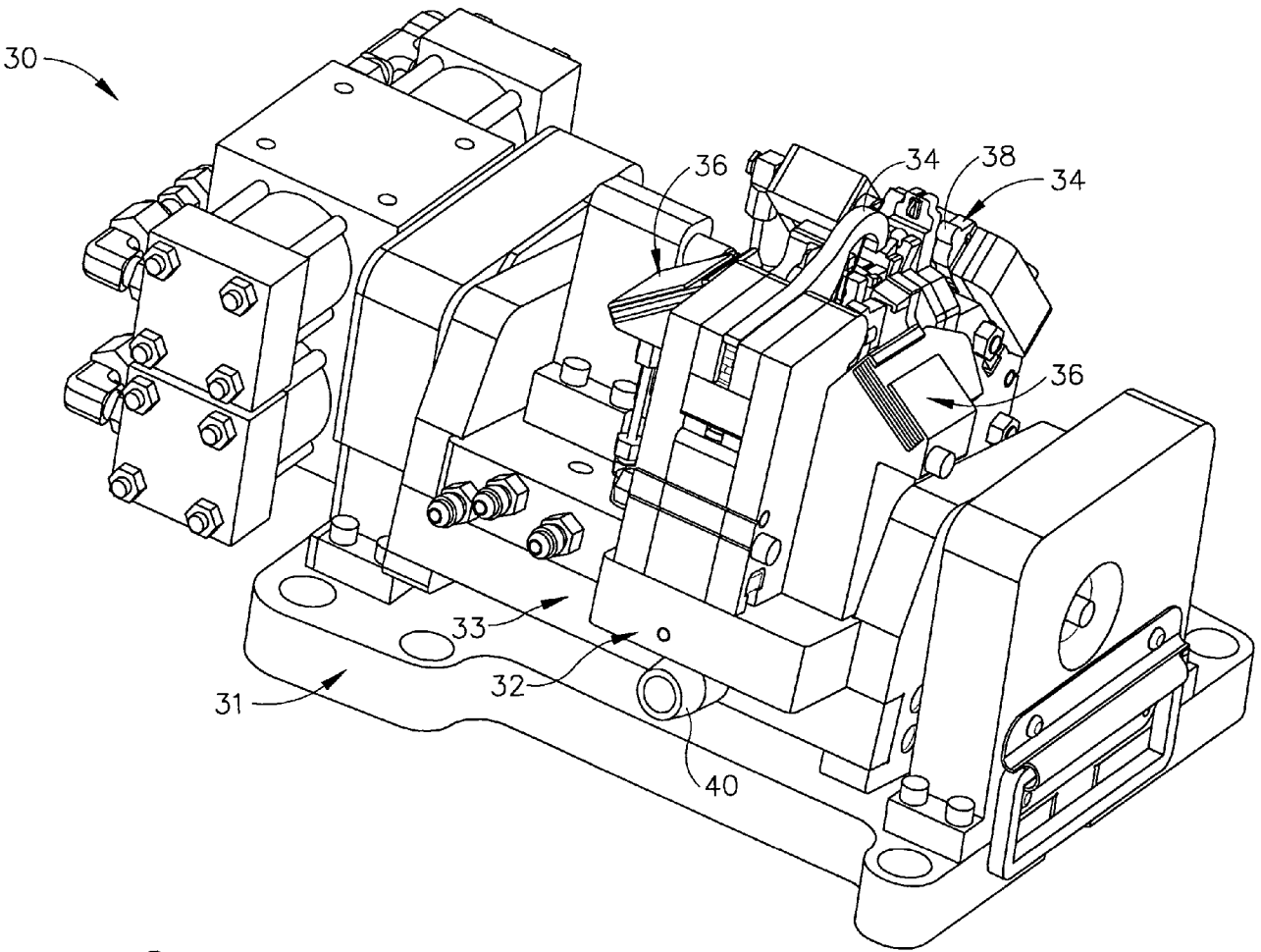
FIG. 2 is a perspective view of an exemplary embodiment of a fixture for use in machining a component, such as the gas turbine engine blade shown in FIG. 1.
Figure 3:
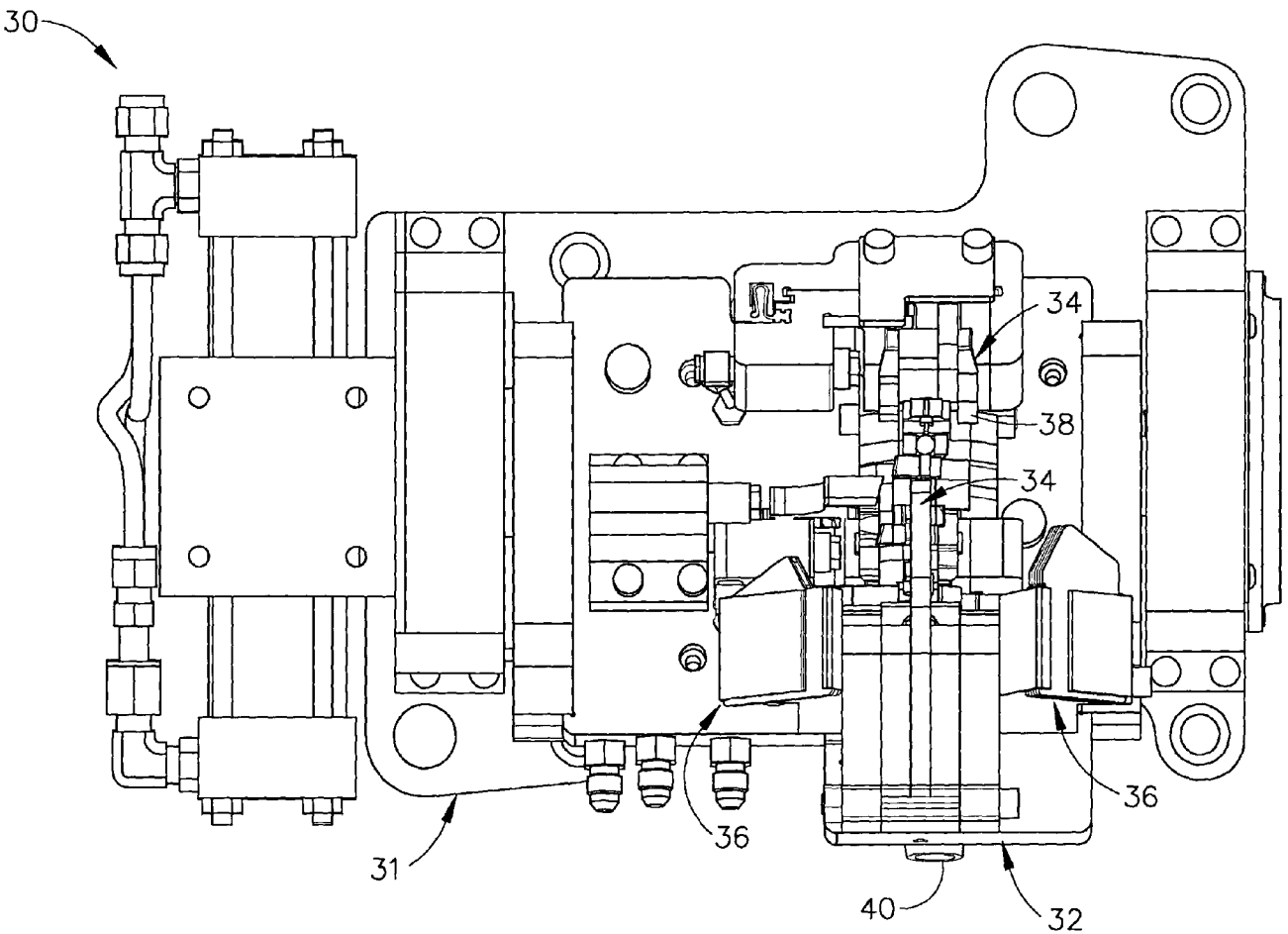
FIG. 3 is a top plan view of the fixture shown in FIG. 2.

FIG. 2 is a perspective view of an exemplary fixture 30 for machining a component. FIG. 3 is a top plan view of fixture 30. Although fixture 30 may be used to machine any component, for example components of any operable shape, size, configuration, and/or material(s), in the exemplary embodiment fixture 30 is used to machine an engine component, such as an engine nozzle (not shown) or an engine blade, such as blade 10 (shown in FIG. 1). Of course, it should be appreciated that the specific size, shape, and/or configuration of fixture 30 described and/or illustrated herein is exemplary only. Accordingly, the specific size, shape, and/or configuration of fixture 30 generally, as well as portions thereof, may be selected to accommodate other components than engine blade 10.

Fixture 30 generally includes a base 32, at least one clamping member 34 coupled to base 32, and at least one nozzle assembly 36 coupled to base 32. In one embodiment, base 32 is fixedly secured to a table 31 that rotates and translates about one or more axes (not shown) to facilitate machining various surfaces of engine blade 10. For example, when base 32 is fixedly coupled to table 31 and engine blade 10 is fixedly coupled to fixture 30 (as described below in more detail), base 32, and engine blade 10, can be moved about one or more axes to allow a machining tool (not shown) access to various surfaces of engine blade 10 for machining thereof.

Engine blade 10 is fixedly coupled to fixture 30 using clamping members 34. Although only two clamping members 34 are illustrated, fixture 30 may include only one, or any number of, clamping members 34. Clamping members 34 may be movable with respect to base 32, for example using electrical, hydraulic, and/or pneumatic power, for fixedly coupling blade 10 to fixture 30. Moreover, rather than being movable, one or more of clamping members 34 may be fixed with respect to base 32. Claming members 34, whether moveable or fixed, include surfaces (e.g., a surface 38) sized and shaped to engage engine blade 10 and secure engine blade 10 to fixture 30. Of course, it should be appreciated that the specific size, shape, and/or configuration of clamping members 34 illustrated herein is exemplary only. Accordingly, the specific size, shape, and/or configuration of clamping members 34 may be selected to accommodate other components than engine blade 10, or may be selected to clamp blade 10 in other configurations than described and/or illustrated herein.

Nozzle assemblies 36 are generally positioned to discharge a cooling fluid (not shown) toward engine blade 10 during machining thereof. Cooling engine blade 10 during machining facilitates protecting blade 10 from damage that may occur as heat is generated as a result of machining. Over time, continued exposure to heat may cause thermal stresses, cracking, burning, and/or micro-structural damage to blade 10. Although only two nozzle assemblies 36 are illustrated, fixture 30 may include only one or any number of nozzle assemblies 36. Fixture 30 may include a coolant supply tube 40 that is coupled in flow communication with a source of cooling fluid (not shown). In some embodiments, nozzle assemblies 36 receive cooling fluid from supply tube 40 via passages (not shown) defined within base 32 and another portion 33 of fixture 30. In some embodiments, nozzle assemblies 36 receive cooling fluid channeled from supply tube 40. Moreover, in some embodiments, nozzle assemblies 36 are each independently connected to the source of cooling fluid for receiving cooling fluid therefrom.

Figure 4:
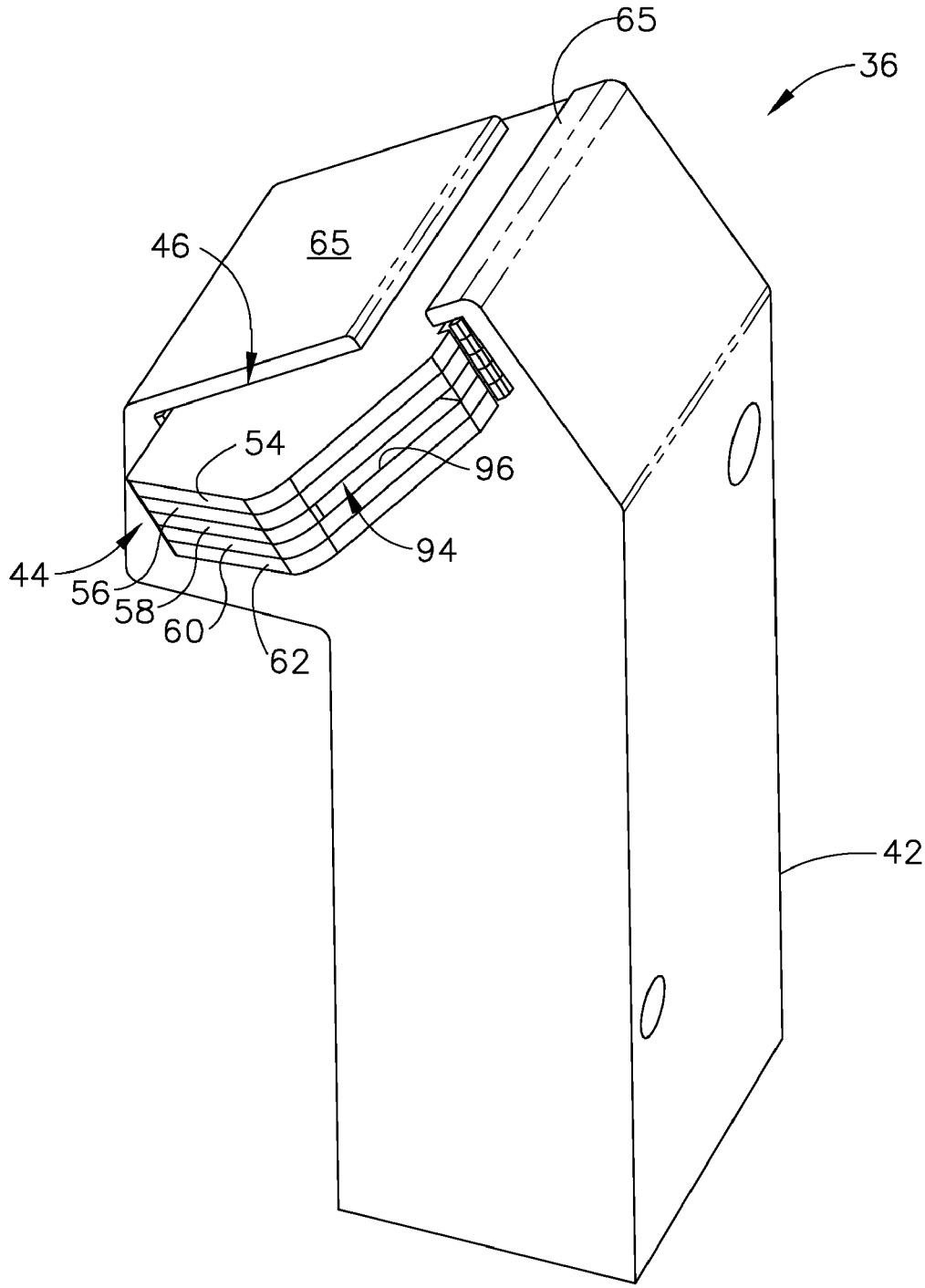
FIG. 4 is an enlarged perspective view of an exemplary embodiment of a nozzle assembly for use with the fixture shown in FIGS. 2 and 3.
Figure 5:
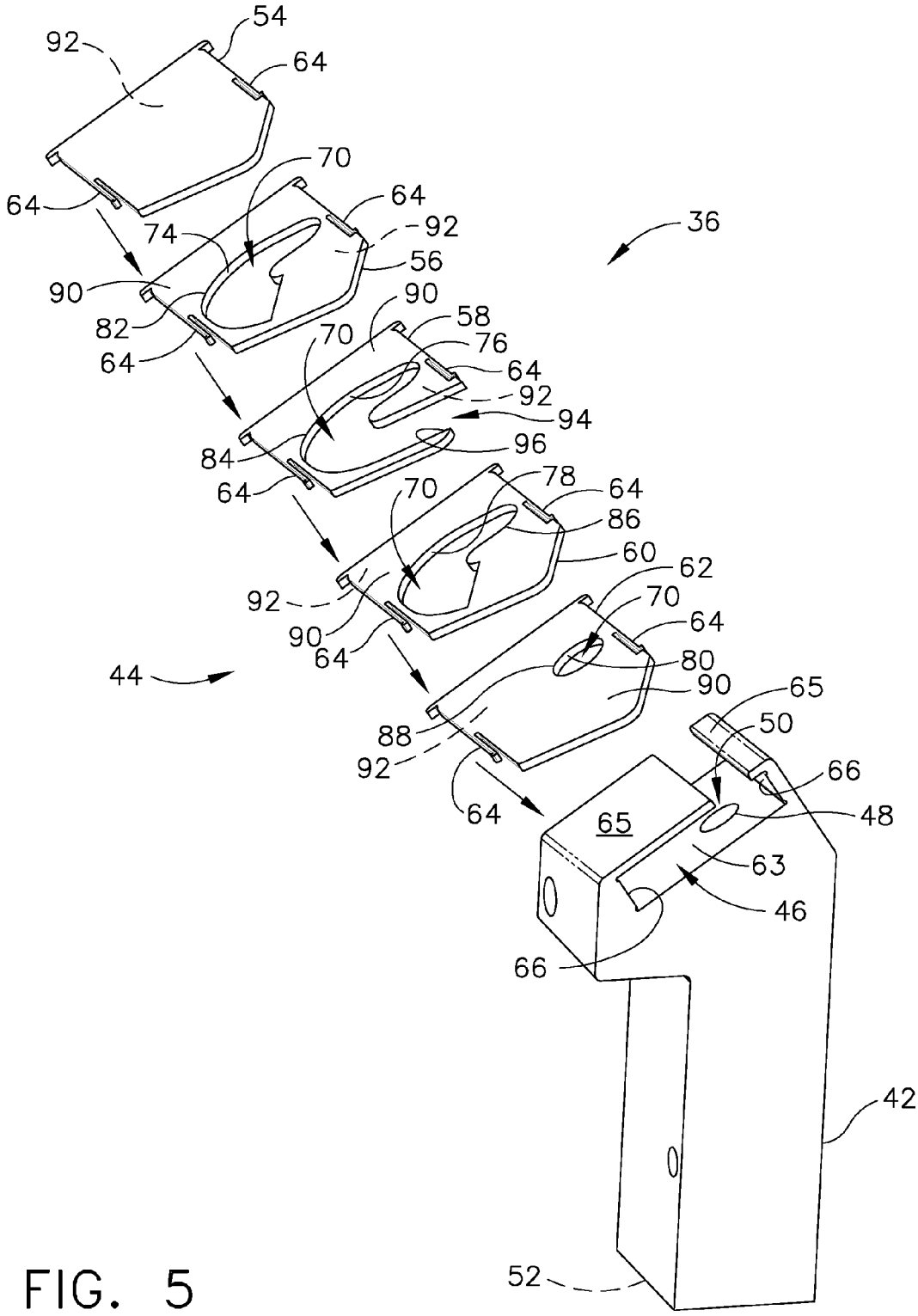
FIG. 5 is an exploded perspective view of the nozzle assembly shown in FIG. 4.

FIG. 4 is a perspective view of an exemplary embodiment of nozzle assembly 36. FIG. 5 is an exploded perspective view of nozzle assembly 36. Nozzle assembly 36 includes a base 42 and a nozzle 44. Base 42 is fixedly secured to fixture base 32 (shown in FIGS. 2 and 3) using any suitable means, such as, but not limited to, threaded fasteners (not shown). Base 42 includes an opening 46 for receiving nozzle 44 and at least one fluid passage 48 defined therein for receiving cooling fluid from, for example, supply tube 40 (shown in FIGS. 2 and 3). Fluid passage 48 extends between an end 50 thereof, generally adjacent opening 46, and an opposite end 52 thereof. Moreover, passage 48 is coupled in flow communication with the source of cooling fluid. In some embodiments, when base 42 is coupled to fixture base 32, fluid passage end 52 is in flow communication with one or more passages defined within fixture base 32 and/or other portions of fixture 30.

Figure 6:
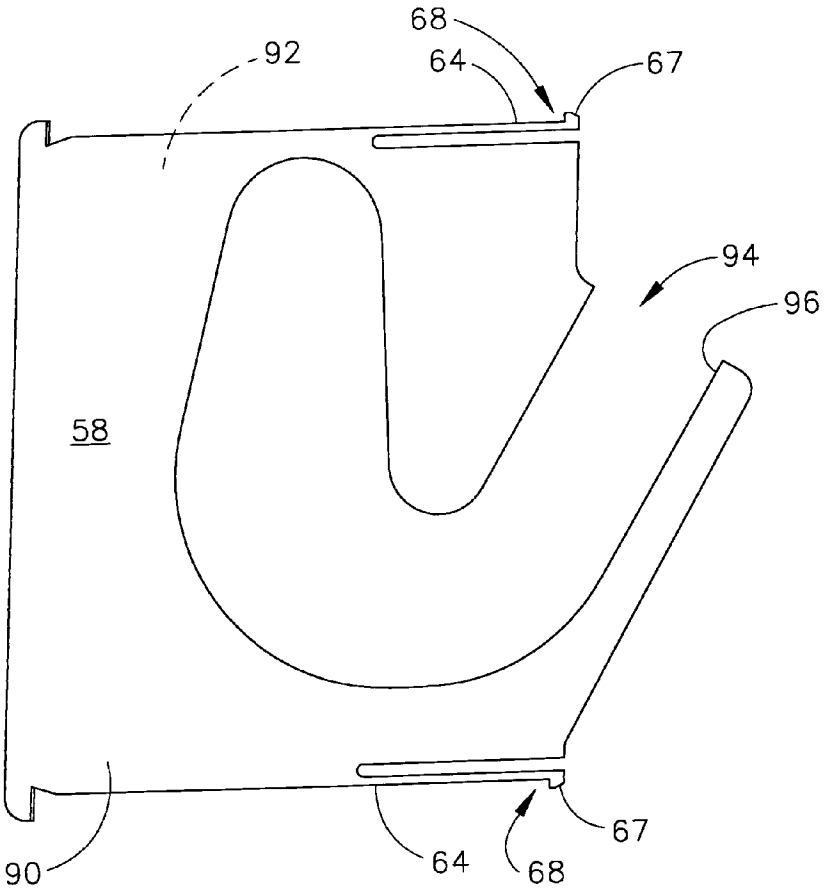
FIG. 6 is a top plan view of an exemplary embodiment of a plate for forming an exemplary nozzle shown in FIGS. 4 and 5.

As shown in FIG. 5, in the exemplary embodiment, nozzle 44 includes a plurality of plates 54, 56, 58, 60, and 62. Although five plates 54, 56, 58, 60, and 62 are illustrated herein, nozzle 44 may include any number of plates. Plates 54, 56, 58, 60, and 62 may have any cross-sectional shape. In the exemplary embodiment, plates 54, 56, 58, 60, and 62 each have a generally rectangular cross-sectional shape. Plates 54, 56, 58, 60, and 62 are stacked together and are sized to be at least partially received within base opening 46 defined by a first nozzle surface 63, first and second retaining surfaces 66, and at least one clamping member 65 extending from at least one of the first retaining surface and the second retaining surface. More specifically, plates 54, 56, 58, 60, and 62 are stacked together such that a mating surface 90 of plates 56, 58, 60,and 62 is substantially flush against a mating surface 92 of plates 54, 56, 58, and 60. Plates 54, 56, 58, 60, and 62 may be coupled to base 42 using any suitable means. In the exemplary embodiment, each plate 54, 56, 58, 60, and 62 includes at least one retaining member 64. As shown in FIG. 6 and with reference to only plate 58, in the exemplary embodiment, plates 54, 56, 58, 60, and 62 each include two opposing retaining members 64. Moreover, in the exemplary embodiment, retaining members 64 are spring clips that are deformed when at least partially received within opening 46. Accordingly, members 64 exert a spring force to nozzle assembly base 42 along surface 66 thereof to facilitate retaining each plate 54, 56, 58, 60, and 62 within opening 46. In the exemplary embodiment, the retaining member of at least some of plates 54, 56, 58, 60 and 62 includes an extension 67, formed adjacent an end 68 thereof that facilitates retaining plates 54, 56, 58, 60, and 62 within opening 46.

As shown in FIG. 5, plates 54, 56, 58, 60, and 62 are inserted within opening 46 as described above, such that a fluid passage 70 is defined herein. Cooling fluid from base fluid passage 48 is channeled through passage 70 and is discharged towards blade 10 during machining thereof. More specifically, plates 54, 56, 58, 60, and 62 each include a respective surface 92, 74, 76, 78, and 80 that at least partially defines fluid passage 70. More specifically, in the exemplary embodiment, plates 56, 58, 60, and 62 each include a respective opening 82, 84, 86, and 88, defined by respective surfaces 74, 76, 78, and 80. Moreover, in some embodiments, fluid passage 70 is at least partially defined by an opening (not shown) formed within nozzle assembly base 42. Any opening within base 42 or any plate of nozzle 44 need not extend completely through base 42 or any plate of nozzle 44. However, in the exemplary embodiment, end plate opening 82, 84, 86, and 88 extends through opposing mating surfaces 90 and 92 of each respective plate 56, 58, 60, and 62. Openings 82, 84, 86, and 88 may be formed using any suitable fabrication process, such as, but not limited to, electrical discharge machining (EDM).

When plates 54, 56, 58, 60, and 62 are stacked and received within base opening 46, fluid passage 70 is in flow communication with fluid passage end 50 for receiving cooling fluid therefrom. At least one of plates 54, 56, 58, 60, and 62 includes an opening (e.g., opening 96 described below) that is in flow communication with fluid passageway 70. Plates 54, 56, 58, 60, and/or 62 are orientated relative to each other such that the opening at least partially defines an outlet 94 for discharging cooling fluid from fluid passage 70 towards blade 10. As shown in FIGS. 4-6, in the exemplary embodiment, only plate 58 includes an opening 96. However, in alternative embodiments, plates 54, 56, 60, and/or 62 include an opening 96 that at least partially defines outlet 94. Moreover, multiple opening 96, whether in the same and/or different plates 54, 56, 60 and/or 62, may be used to at least partially define other outlets (not shown) for discharging cooling fluid from fluid passage 70 in different directions and/or different discharge patterns.

A size and/or shape of fluid passage 70 is pre-selected to facilitate providing a desired flowrate and/or a desired flow pattern of the cooling fluid within fluid passage 70. As can be appreciated by one skilled in the art, the size and/or shape of each of openings 82, 84, 86, and 88, as well as the arrangement of the stack of plates 54, 56, 58, 60, and 62 is variably selected to provide a desired size and/or shape of fluid passage 70. Although fluid passage 70 may include any general shape, in some embodiments, fluid passage 70 includes a generally circular, oval, triangular, and/or quadrilateral cross section.

Similarly, a size and/or shape of outlet 94 is variably selected such that cooling fluid discharged from outlet 94 has a pre-selected flowrate and/or a pre-selected cross-sectional discharge pattern, for example, to facilitate providing a desired flow of cooling fluid to blade 10. As can be appreciated by one skilled in the art, the size and/or shape of opening 96 (and/or any other openings defining outlet 94), as well as an arrangement of the stack of plates 54, 56, 58, 60, and 62 can be pre-selected to provide the desired size and/or shape of outlet 94. Although outlet 94 may include any general shape, in some embodiments, outlet 94 includes a generally circular, oval, triangular, and/or quadrilateral cross section.

In operation, and for example, cooling fluid is received by supply tube 40 and flows through the passages within base 32 and portion 33 of fixture 30, fluid passage 48 of nozzle assembly base 42, and into fluid passage 70 of nozzle 44. Cooling fluid is then discharged through outlet 94 and thereby delivered to engine blade 10 to cool engine blade 10. Because nozzle assembly base 42 is generally rigid and nozzle 44 is fixedly retained within opening 46 of base 42 by, the at least one clamping member 65 applying a force against deflecting plate 54 when deflecting plate 54 is inserted within opening 46, nozzle 44 may be less likely to be damaged or misaligned during loading of blade 10 onto fixture 30 and/or during maintenance of fixture 30. Nozzle 44 may also be less likely to vibrate loose during movement of fixture 30 because base 42 is fixedly coupled to fixture 30 and nozzle 44 is fixedly retained within opening 46. Moreover, even if nozzle 44 is damaged, nozzle 44 can be replaced with an undamaged nozzle by replacing plates 54, 56, 58, 60, and/or 62 with undamaged plates. Accordingly, nozzle assembly 36 may facilitate easier replacement of nozzle 44 without realignment thereof, possibly leading to shorter maintenance times. Moreover, if different nozzles are desired, for example due to machining of a different component, different machining processes of the same component, and/or machining different areas of the same component, nozzle assembly 36 may facilitate shorter cycle times between components and/or processes.

Although the nozzles, assemblies, and methods described and/or illustrated herein are described and/or illustrated with respect to gas turbine engine components, and more specifically a rotor blade for a gas turbine engine, practice of the nozzles, assemblies, and methods described and/or illustrated herein is not limited to engine blades, nor gas turbine engine components generally. Rather, the nozzles, assemblies, and methods described and/or illustrated herein are applicable to any component and/or any machining process.

Exemplary embodiments of methods, nozzles, and assemblies are described and/or illustrated herein in detail. The methods, nozzles, and assemblies are not limited to the specific embodiments described herein, but rather, components of each nozzle and components of each assembly, as well as steps of each method, may be utilized independently and separately from other components and steps described herein. Each component, and each method step, can also be used in combination with other components and/or method steps.

When introducing elements/components/etc. of the methods, nozzles, and assemblies described and/or illustrated herein, the articles "a", "an", "the" and "said" are intended to mean that there are one or more of the element(s)/component (s)/etc. The terms "comprising", "including" and "having" are intended to be inclusive and mean that there may be additional element(s)/component(s)/etc. other than the listed element(s)/component(s)/etc.

While the invention has been described in terms of various specific embodiments, those skilled in the art will recognize that the invention can be practiced with modification within the spirit and scope of the claims.

What is claimed is:

1. A method for fabricating a nozzle for use with a fixture for machining a part, said method comprising:

providing a base and at least two plates, wherein a first plate of the at least two plates is a deflecting plate and wherein a second plate of the at least two plates includes a first opening that extends to a perimeter of the second plate, and wherein each of the first and second plates includes at least one mating surface;

stacking the first and second plates together such that the mating surface of the first plate is substantially flush against the mating surface of the second plate and such that at least a portion of a fluid passage is defined by the at least two plates, wherein the at least a portion of the fluid passage is configured to enable a fluid to enter the nozzle in a first direction; and orienting the first and second plates relative to each other such that the first opening at least partially defines an outlet for discharging the fluid from the nozzle, wherein the first plate facilitates discharging the fluid from the outlet in a second direction that is different than the first direction, wherein the at least two plates are removably coupled at least partially within an opening defined in the base to enable at least one of a size and a shape of the outlet to be variably selected to facilitate producing at least one of a pre-determined flowrate and a pre-determined discharge pattern of the fluid from the nozzle, the base including a first retaining surface, an opposing second retaining surface, and at least one base clamping member extending from at least one of the first retaining surface and the second retaining surface, wherein the at least one base clamping member applies a force against the first plate when the first plate is inserted within the opening defined in the base, and wherein the base is configured to be fixedly coupled to the fixture when the fluid is discharged from the nozzle.

2. A method in accordance with claim 1 wherein said providing a base and at least two plates comprises forming a second opening in the second plate such that the second opening at least partially defines the fluid passage.

3. A method in accordance with claim 1 further comprising coupling at least one spring clip to at least one of the at least two plates to couple the at least one of the at least two plates at least partially within the opening of the base.

4. A nozzle for use with a fixture for machining a part, said nozzle comprising a base and at least two plates, each plate of said at least two plates comprising at least one mating surface, said at least two plates stacked together such that a mating surface of a first plate of said at least two plates is substantially flush against a mating surface of a second plate of said at least two plates and such that at least a portion of a fluid passage is defined by said at least two plates, said first and second plates oriented to facilitate enabling a fluid to enter said at least a portion of the fluid passage in a first direction, said second plate comprising an opening that extends to a perimeter of said second plate, said opening at least partially defining an outlet for discharging the fluid from said nozzle, wherein said first plate facilitates discharging the fluid from said outlet in a second direction that is different than the first direction, said at least two plates configured to be removably coupled at least partially within an opening defined in said base to enable at least one of a size and a shape of said outlet to be variably selected to facilitate producing at least one of a pre-determined flowrate and a pre-determined discharge pattern of the fluid from said nozzle, said base comprising a first retaining surface, an opposing second retaining surface, and at least one base clamping member extending from at least one of said first retaining surface and said second retaining surface, wherein said at least one base clamping member applies a force against said first plate when said first plate is inserted within said opening defined in said base, and wherein said base is configured to be fixedly coupled to the fixture when the fluid is discharged from said nozzle.

5. A nozzle in accordance with claim 4 wherein said fluid passage extends through said mating surface of said second plate.

6. A nozzle in accordance with claim 4 wherein each of said at least two plates comprises at least one retaining member for coupling said at least two plates at least partially within said opening of said base.

7. A nozzle in accordance with claim 6 wherein said at least one retaining member comprises a spring.

8. A nozzle in accordance with claim 4 wherein each of said at least two plates has a generally rectangular cross-sectional shape.

9. A nozzle in accordance with claim 4 wherein said outlet comprises one of a generally circular, a generally oval, a generally triangular, and a generally quadrilateral cross-sectional shape.

10. A nozzle in accordance with claim 4 wherein said fluid passage comprises at least one of a generally circular, a generally oval, a generally triangular, and a generally quadrilateral cross-sectional shape.

11. A nozzle in accordance with claim 4 wherein said at least one base clamping member covers at least a portion of said mating surface of said first plate when said first plate is inserted into said opening defined within said base.

12. A nozzle in accordance with claim 4 wherein said at least one base clamping member applies a force against said first plate in a direction substantially perpendicular to a plane formed by said mating surface of said first plate when said first plate is inserted into said opening defined within said base.

13. A nozzle in accordance with claim 4 wherein said at least one base clamping member comprises a first base clamping member that extends from said first retaining surface, and a second base clamping member that extends from said second retaining surface.

14. A nozzle in accordance with claim 13 wherein said first base clamping member extends substantially perpendicularly from said first retaining surface and said second base clamping member extends substantially perpendicularly from said second retaining surface.

15. A nozzle in accordance with claim 13 wherein said first base clamping member extends towards said second retaining surface, and said second base clamping member extends towards said first retaining surface.

16. A nozzle in accordance with claim 13 wherein a gap is defined between said first base clamping member and said second clamping member.

* * * * *